United States Patent [19]

Küper

[11] 4,347,677

[45] Sep. 7, 1982

[54] SNOW REMOVAL BAR FOR THE SNOW REMOVAL PLATE OF A SNOW PLOW

[75] Inventor: Walter Küper, Bochum-Stiepel, Fed. Rep. of Germany

[73] Assignee: Gummi Kuper GmbH & Co. KG, Bochum, Fed. Rep. of Germany

[21] Appl. No.: 244,838

[22] Filed: Mar. 18, 1981

Related U.S. Application Data

[63] Continuation-in-part of Ser. No. 115,832, Jan. 28, 1980, Pat. No. 4,288,932.

[30] Foreign Application Priority Data

May 2, 1979 [DE] Fed. Rep. of Germany ..... 2904251

[51] Int. Cl.[3] ..... E01H 5/06

[52] U.S. Cl. ..... 37/233

[58] Field of Search ..... 37/42 VL, 42 R, 50, 37/142 A, 41; 172/767, 801

[56] References Cited

U.S. PATENT DOCUMENTS

| | | | |
|---|---|---|---|
| 3,466,766 | 9/1969 | Kahlbacher | 37/42 VL X |
| 3,477,149 | 11/1969 | Wagner | 37/42 VL |
| 4,132,017 | 1/1979 | Robson | 37/42 VL X |

FOREIGN PATENT DOCUMENTS

| | | | |
|---|---|---|---|
| 1243526 | 9/1960 | France | 37/42 VL |
| 1255480 | 1/1961 | France | 37/42 VL |
| 1058602 | 2/1967 | United Kingdom | 37/42 VL |

*Primary Examiner*—E. H. Eickholt

*Attorney, Agent, or Firm*—Thomas M. Galgano; Allison C. Collard

[57] ABSTRACT

A snow removal bar for the snow removal plate of a snow plow consists of a rubber or plastic element which is reinforced with steel plates on both sides thereof, and which has an upper edge mounted on the lower edge of the snow removal plate with screws. Hard material elements, preferably metal or corundum, are embedded in the rubber or plastic element.

6 Claims, 1 Drawing Figure

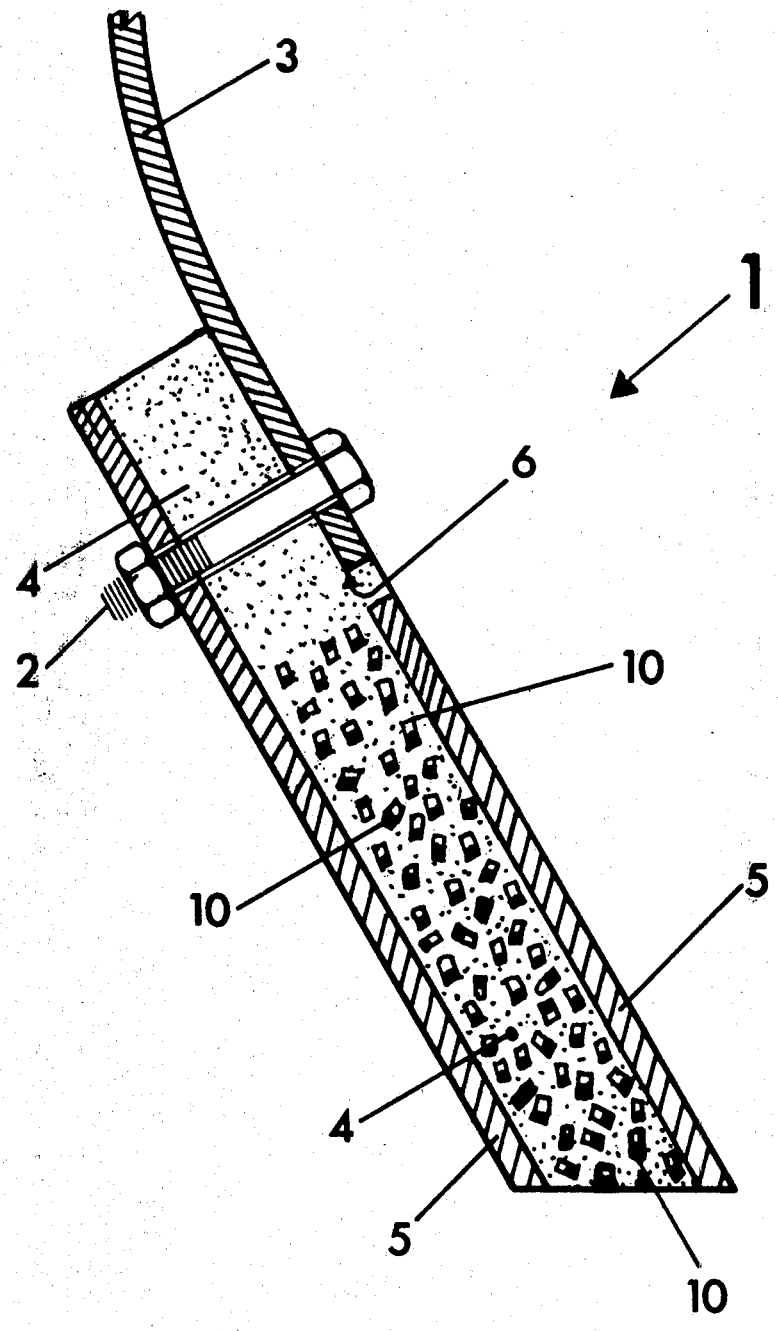
3
1
6
4
2
10
10
5
4
5
10

SNOW REMOVAL BAR FOR THE SNOW REMOVAL PLATE OF A SNOW PLOW

This is a continuation-in-part of Ser. No. 115,832 filed Jan. 28, 1980 now U.S. Pat. No. 4,288,932.

The invention relates to a snow removal bar for a snow removal plate of a snow removal plow. More particularly, it relates to such a snow removal bar consisting of a rubber or plastic element which is reinforced on both sides thereof with steel plates, and which has an upper edge which is mounted by means of screws on the lower edge of the snow removal plate.

In accordance with the state of the art (German petty patent 77 02 414), snow removal bars of the abovementioned type are known, wherein the front and rear surfaces of the rubber or plastic element are convered with steel plates over the total width of the snow removal bar. Such snow removal bars, due to their sandwich structure (steel-rubber-steel), are able to remove ice or compacted snow from the road surface, and still have very good wear and tear characteristics, because the rubber or plastic which is covered on both sides is protected against mechanical damage caused by sharp objects present on the road surface. Therefore, the rubber or plastic material is only exposed to the normal wear which, as is very well known, is less in rubber or plastic, than in steel.

Due to the relatively high friction coefficients between the rubber or plastic, on the one hand, and the road surface, on the other hand, relatively high friction forces are generated while operating the snow plow. These cause a high drive resistance, on the one hand, and a relatively high wear of the rubber or plastic elements, on the other hand.

It is therefore an object of the invention to improve a snow removal bar of the aforementioned type which has improved sliding and reduced wear characteristics.

This object of the invention is attained by the provision of a snow removal bar of the aforementioned type, wherein hard material elements, in particular, made of hard metal or corundum, are embedded in the plastic or rubber material between the two steel plates.

Such hard materials which are embedded into the plastic or rubber may have a grain size of from 0.5 to 3 cm, for example, thereby favorably influencing the wear and the sliding characteristics of the snow removal bar. Of all the materials used in the snow removal bar, the hard material elements have the highest wear characteristics, so that they protrude from the lower edge of the snow removal bar in the form of rounded off shoulders, after a certain operating time. Due to their hardness, these hard material shoulders slide relatively easily on the road surface and support a larger part of the snow removal plate at a relatively low drive resistance. The drive resistance is considerably lower in contrast to the rubber or plastic material sliding on the road surface. Due to the fact that the very hard, but also very brittle hard material elements are embedded in the elastic rubber or plastics mass, they are able to withstand sudden shocks which would result in the destruction of the hard material elements, if they would be mounted in a rigid, non-elastic manner. The steel plates which are provided on both surfaces prevent the embedded hard material elements from being pushed out laterally therefrom.

Other objects and features of the present invention will become apparent from the following detailed description when taken in connection with the accompanying drawing which discloses one embodiment of the invention. It is to be understood that the drawing is designed for the purpose of illustration only and is not intended as a definition of the limits of the invention.

In the drawing, a vertical sectional view through a snow removal bar embodying the present invention is shown, as well as the lower area of the snow removal plate of a snow plow.

Referring now in detail to the drawing, a snow removal bar 1 is shown which is mounted by means of screw or bolt assemblies 2 on the lower edge of a snow removal plate 3 of a snow plow. Snow removal bar 1 is provided with an element 4 made of wear resistant rubber or plastic material. The lower area of rubber or plastic element 4 is reinforced by steel plates 5 which brace both surfaces of the rubber or plastic element and which extend across the total width of snow removal bar 1.

In the area of the upper edge of snow removal bar 1, a recess 6 is provided which serves to accommodate the lower edge of snow removal plate 3.

Hard material elements 10 are embedded in the rubber or plastic mass of element 4 between steel plates 5. These hard material elements consist of hard metal or corundum granules with a granular size of about 0.5 to 3 cm, for example.

Thus, while only one embodiment of the present invention has been shown and described, it will be obvious that many changes and modifications may be made thereunto, without departing from the spirit and scope of the invention.

What is claimed is:

1. A snow removal bar for a snow removal plate of a snow removal plow of the type including a rubber intermediary element which is reinforced with steel plates disposed on both sides thereof and which has an upper edge which is mounted by means of bolts on the lower edge of the snow removal plate, the improvement comprising:

said intermediary element having an exposed bottom edge disposed for engagement with a road surface an a multiplicity of particle-like hard material elements embedded therein and distributed within the area between said two steel plates, said hard material elements being more wear resistant and having a lower coefficient of friction than said rubber intermediary element relative to the road surfce so that they will protrude from the lower edge of the snow removal bar in the form of rounded-off shoulders after a certain operating time, which rounded-off shoulders may slide relatively easily on the road surface, thereby lowering the drive resistance and increasing the wear resistance of the intermediary element and, in turn, the snow removal bar.

2. The snow removal bar in accordance with claim 1, wherein said hard material elements are selected from the group consisting of hard metal granules and corundum granules.

3. The snow removal bar in accordance with claims 1 or 2, wherein said hard material elements have a grain size of about 0.5 to 3 cm.

4. A snow removal bar for a snow removal plate of a snow removal plow of the type including a plastic intermediary element which is reinforced with steel plates disposed on both sides thereof and which has an upper edge which is mounted by means of bolts on the lower edge of the snow removal plate, the improvement comprising:

said intermediary element having an exposed bottom edge disposed for engagement with a road surface and a multiplicity of particle-like hard material elements embedded therein and distributed within the area between said two steel plates, said hard material elements being more wear resistant and having a lower coefficient of friction than said plastic intermediary element relative to the road surface so that they will protrude from the lower edge of the snow removal bar in the form of rounded-off shoulders after a certain operating time, which rounded-off shoulders may slide relatively easily on the road surface, thereby lowering the drive resistance and increasing the wear resistance of the intermediary element and, in turn, the snow removal bar.

5. The snow removal bar in accordance with claim 4, wherein said hard material elements are selected from the group consisting of hard metal granules and corundum granules.

6. The snow removal bar in accordance with claim 4 or 5, wherein said hard material elements have a grain size of about 0.5 to 3 cm.

* * * * *